US005307857A

United States Patent [19]

Kraeutler

[11] Patent Number: 5,307,857

[45] Date of Patent: May 3, 1994

[54] BALANCING DEVICE FOR A RAISABLE-CURTAIN GOODS-HANDLING DOOR

[75] Inventor: Bernard Kraeutler, Dunieres, France

[73] Assignee: Nergeco (société anonyme), Dunieres, France

[21] Appl. No.: 37,398

[22] Filed: Mar. 26, 1993

[30] Foreign Application Priority Data

Mar. 27, 1992 [FR] France ..... 92 03706

[51] Int. Cl.[5] ..... E05F 11/00

[52] U.S. Cl. ..... 160/190

[58] Field of Search ..... 160/190, 193, 4, 1, 160/7, 9, 8, 133

[56] References Cited

U.S. PATENT DOCUMENTS

| | | | |
|---|---|---|---|
| 991,605 | 5/1911 | Byrne | 160/133 X |
| 1,750,042 | 3/1930 | Hoover | 160/190 |
| 3,878,879 | 4/1975 | Manns | 160/133 X |
| 3,981,343 | 9/1976 | DeVito | 160/193 X |
| 4,727,919 | 3/1988 | Kraeutler | 160/9 X |
| 5,103,890 | 4/1992 | Cloutier | 160/190 |

FOREIGN PATENT DOCUMENTS

| | | |
|---|---|---|
| 0276045 | 7/1988 | European Pat. Off. . |
| 0338225 | 10/1989 | European Pat. Off. . |
| 49843 | 3/1889 | Fed. Rep. of Germany . |
| 661098 | 5/1979 | U.S.S.R. . |

*Primary Examiner*—David M. Purol
*Attorney, Agent, or Firm*—Sughrue, Mion, Zinn, Macpeak & Seas

[57] ABSTRACT

A balancing apparatus for a raisable-curtain goods-handling door includes a shaft on which a curtain is wound up or on which curtain-raising straps are wound up. The shaft supports two drums onto which are wound belts from which two counterweights are suspended. The "long" belt from which a "long" counterweight of "long" mass $M_6$ is suspended has a length that corresponds to the full stroke of the curtain while the "short" belt of the "short" other counterweight of "short" mass $M_5$ is shorter and is fastened on the corresponding drum in such a manner as to enable it to wind in either direction on the drum.

4 Claims, 4 Drawing Sheets

BALANCING DEVICE FOR A RAISABLE-CURTAIN GOODS-HANDLING DOOR

BACKGROUND OF THE INVENTION

The present invention relates to a balancing device for a raisable-curtain goods-handling door: doors in factories, warehouses, garages, shops, etc., comprise a shaft for winding up a curtain or for winding up straps that raise a curtain, said shaft having two drums for winding belts on which two counterweights are suspended, the curtain being intended mainly for opening or closing a door-bay which is generally provided to allow vehicles to pass therethrough, e.g. cars, trucks, goods-handling vehicles, etc.

Such a door is usually actuated by an electric motor. In order to reduce the motor driving force, and also to make it possible to operate the door in the event of a power failure, provision is made for a counterweight to move down while the curtain door moves up. Although effective in numerous applications, there are cases where drawbacks arise. In particular, with some doors, the weight of the hanging portion of the curtain varies, becoming less as the curtain moves up.

For example, when the curtain is wound onto a shaft at the top of the curtain, the wound-up portion of the curtain no longer exerts a gravity force, and only the hanging portion that has not yet been wound up needs to be supported. The curtain may be constituted by panels that slide between slideways, with the panels being folded horizontally or nearly horizontally above the door, such that panels disposed on a horizontal slideway portion no longer exert any gravity force. There also exists doors made up of panels which on being raised are stored above the door in a position where they no longer exert a gravity force. Other such situations also exist. The invention also applies to doors in sections where door elements are tilted into a horizontal position, providing the door-raising mechanism is in driving connection with a shaft for winding counterweight belts.

Whatever the structure of the curtain, when it comes to the top of its upward stroke, in the above cases, it exerts relatively little residual gravity force whereas the force exerted by the counterweights does not vary. A damaging inertia effect can thus occur at the end of the upward stroke.

Proposals have already been made for a counterweight device proposing a plurality of masses which stop at different levels as they move downwards (see U.S. Pat. No. 1,750,042 and Soviet patent 661.098).

That device is effective, but is not suitable for all applications.

SUMMARY OF THE INVENTION

According to the present invention, a balancing device for a raisable-curtain goods-handling door comprises two counterweights, one of which is suspended from a belt that is shorter than the stroke of the corresponding counterweight during a full displacement of the curtain (winding up or winding down), and the belt is suitable for winding in both directions, such that after the counterweight has moved down a certain distance, the counterweight belt winds in the opposite direction while the curtain continues to move up, such that said counterweight moves up and thus exerts an opposing force instead of a driving force.

It is quite convenient to use two counterweights, each disposed at a respective end of the wind-up shaft. Systems could be designed making use of three or more counterweights so as to provide finer balancing, but they would be more complicated.

BRIEF DESCRIPTION OF THE DRAWINGS

Other characteristics and advantages of the present invention appear from the following description of a windable flexible curtain given by way of non-limiting example with reference to the accompanying drawings, and showing clearly how the invention can be implemented.

FIG. 1A, curtain paid out;

FIG. 2A, curtain halfway up; and

FIG. 3A, curtain wound up.

MORE DETAILED DESCRIPTION

Figure 1A:
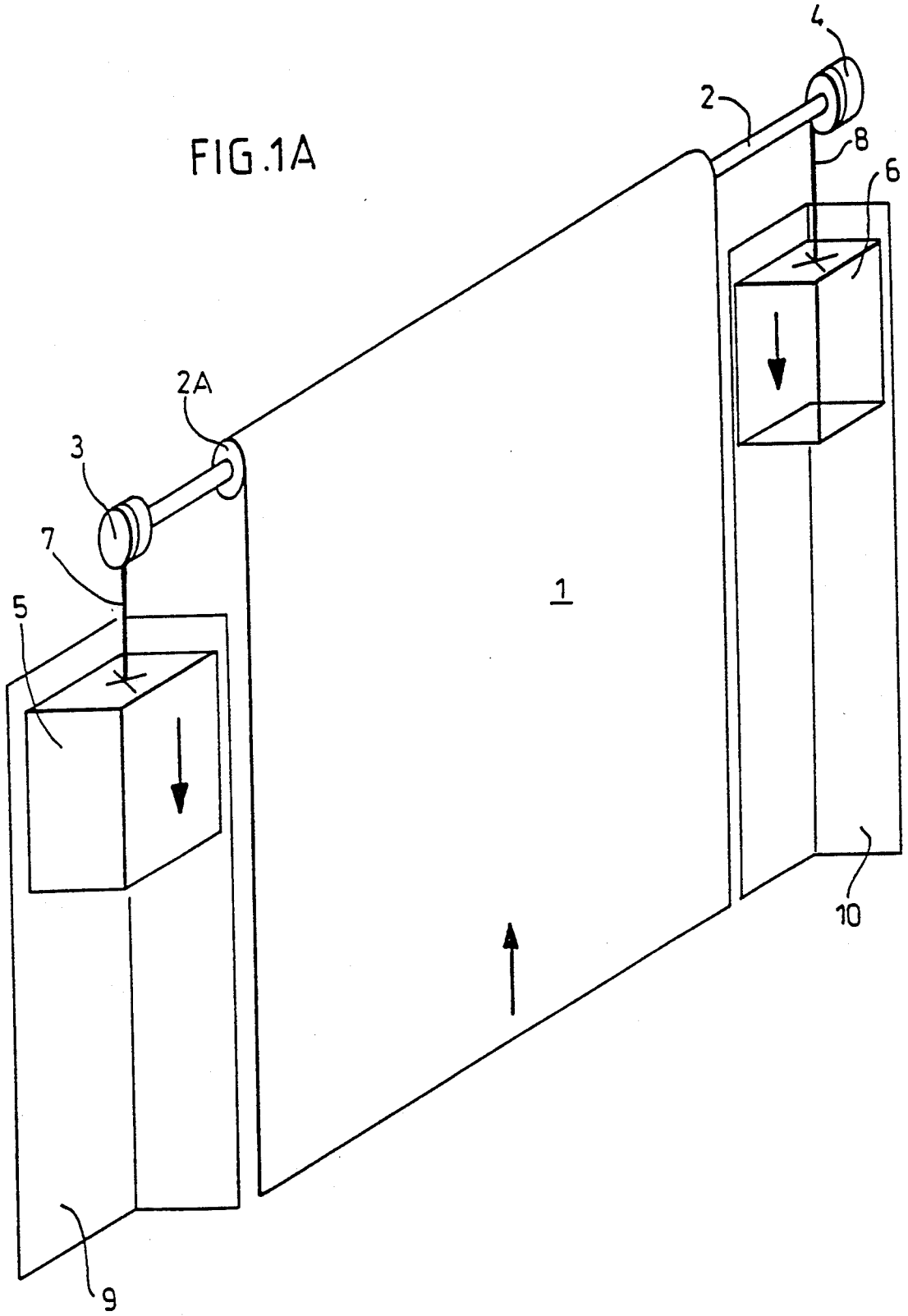
FIGS. 1A, 2A, and 3A are diagrams of a curtain suitable for winding onto a shaft, associated with two counterweights suspended by respective belts that can be wound onto respective ends of the curtain wind-up shaft, the figures showing the system in the following respective positions.
Figure 2A:
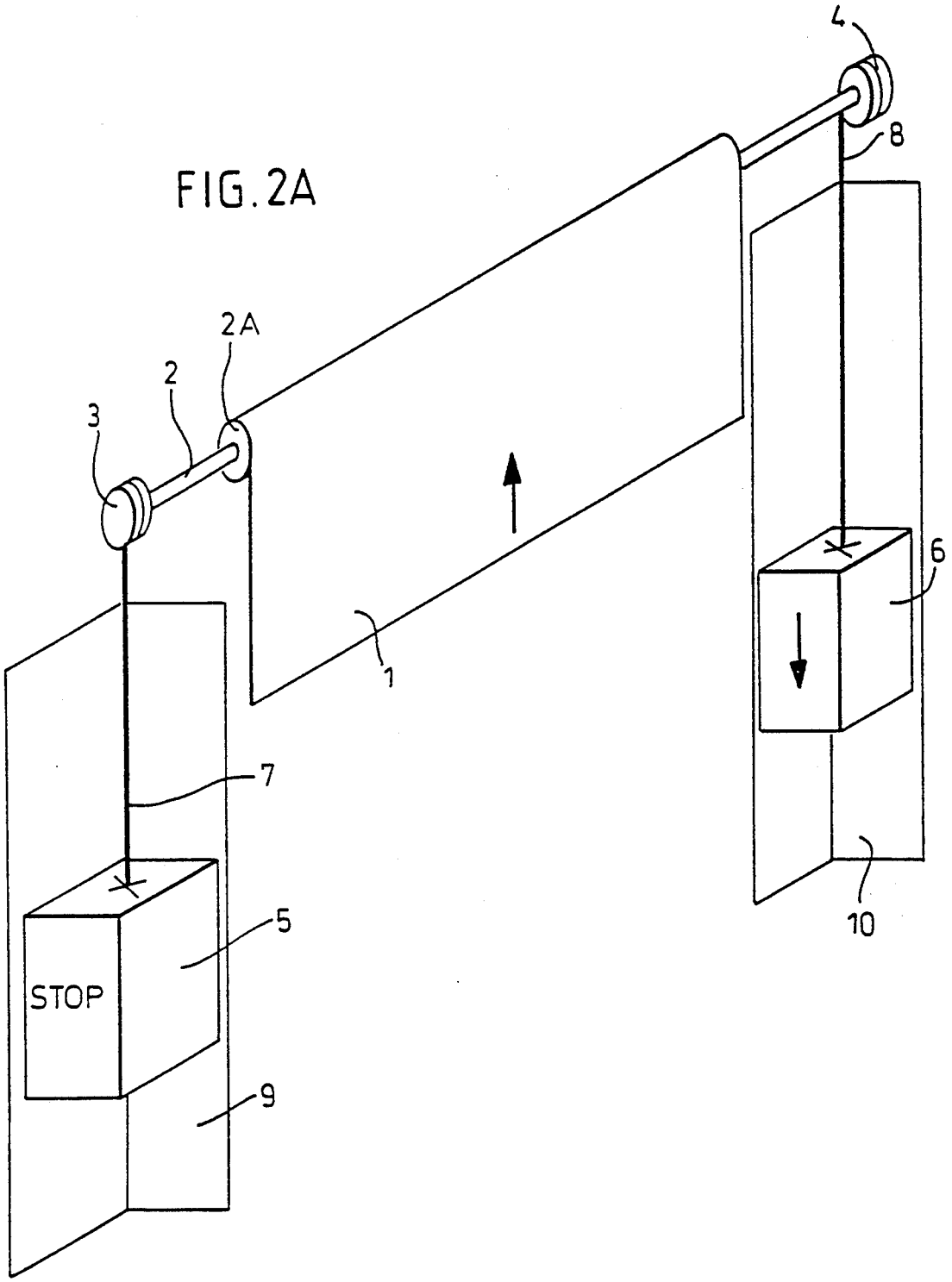

FIG. 1A shows the elements relating to the present invention of a raisable-curtain door having a curtain 1 that can be wound on and off a shaft 2, optionally fitted with a drum 2A, for the purpose of raising and lowering the curtain. The shaft 2 is longer than the width of the curtain, and two drums 3 and 4 are disposed on the wind-up shaft, e.g. one on either side of the curtain 1. Two counterweights 5 and 6 are suspended by belts 7 and 8, respectively that are suitable for winding onto the drums. The counterweights move in appropriate passages 9 and 10, which passages are shown in part. The door generally includes other elements (not shown) such as vertical lateral uprights including slideways for the edges of the curtains, and top cross-member housing the shaft 2 together with an electric motor, a transmission system, and an end-of-stroke switch. The curtain may be reinforced by horizontal reinforcing bars placed at different levels, and which may be wound onto the shaft 2 together with the curtain. A ballasting bar may also be provided at the bottom edge of the curtain.

Figure 3B:
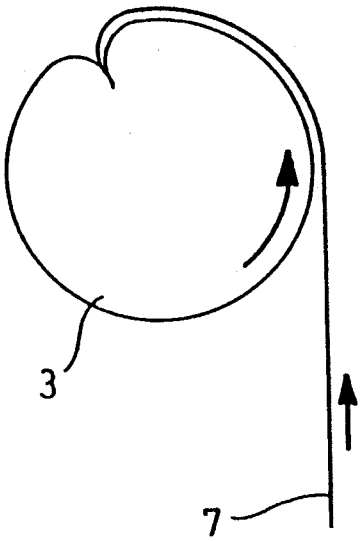
FIGS. 1B, 2B, and 3B are sections through the wind-up shaft and the belt for suspending one of the counterweights, in positions that correspond to FIGS. 1A, 2A, and 3A, respectively.
Figure 3A:
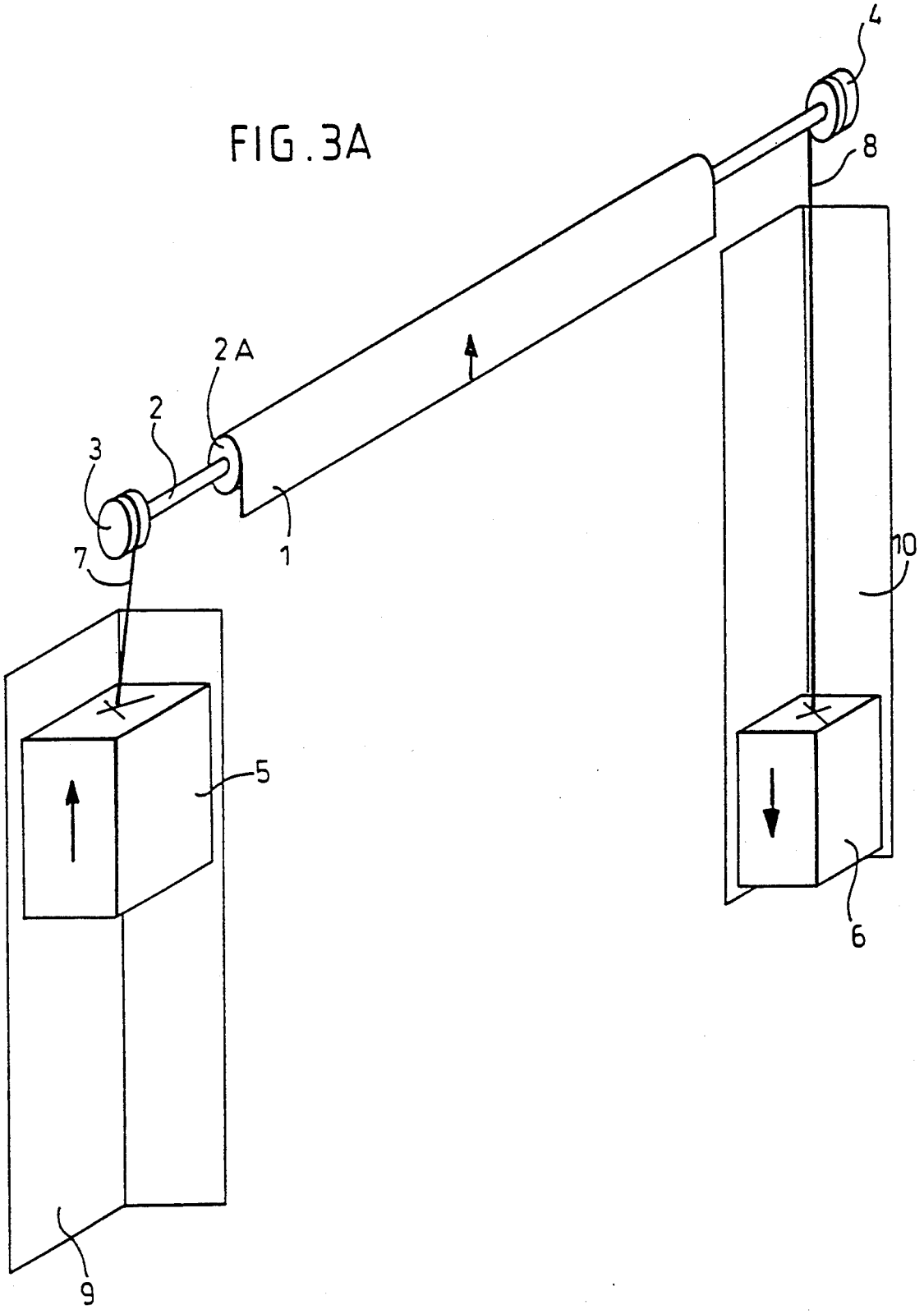

The counterweight 6 is disposed in conventional manner. When the curtain is down (fully paid-out), the counterweight is high; as the curtain moves up, the counterweight moves down; and when the curtain is raised (FIG. 3A), the counterweight is in a low position. The stroke of the counterweight 6 may be the same as that of the curtain, or it may be different, depending on the diameters selected for the curtain wind-up shaft and for the drum 4. The mass of the counterweight is selected accordingly. This mass is referred to below as the "long" mass (of the "long" counterweight), and the belt from which it is suspended is referred to as the "long" belt.

Figure 2B:
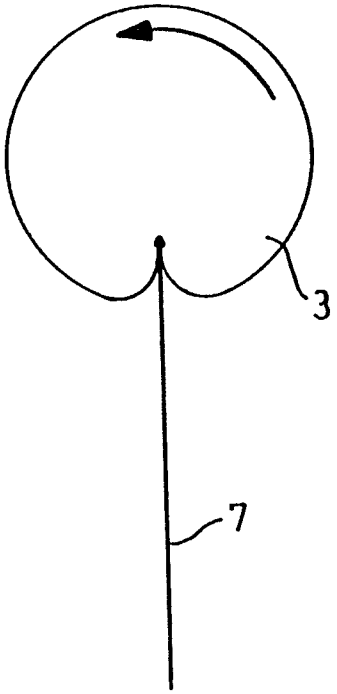
Figure 1B:
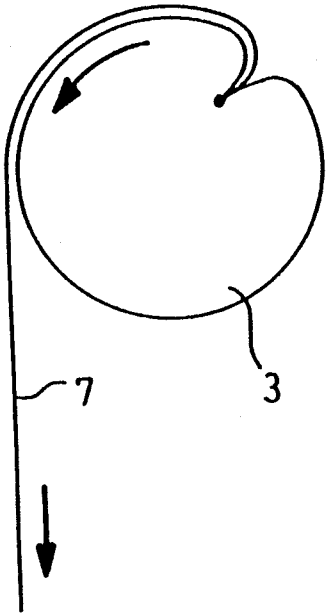

The counterweight 5 is installed in accordance with the present invention. The belt 7 is shorter than the stroke of the counterweight that corresponds to the full stroke of the curtain 1, and the belt is mounted on the drum 3 in such a manner as to be capable of being wound thereon in either direction (see in particular FIGS. 1B, 2B, and 3B). This counterweight is referred to below as the "short" counterweight, its mass as the "short" mass, and the belt on which it is suspended as the "short" belt. The belt can be fixed in various different ways. Such methods of fastening are known. It is also possible to use a cable. The drum may include grooves for facilitating regular winding of the cable. When using a belt, it winds onto itself and so the winding diameter increases as the counterweight moves up. The counterweight thus initially exerts a higher force and this is an advantage when it is necessary to begin winding up a curtain whose total weight needs to be raised.

The counterweights may be equal or different. In general, the counterweight 6 is the heavier.

Under such conditions, the device operates as follows:

When the door is in its closed position (FIGS. 1A and 1B), the curtain is down (paid out) and both counterweights are up. The curtain is held in this position by a brake, in general a brake incorporated in an electric motor. Provision may be made for the force that results from the two counterweights to be greater than the force required to raise the curtain. Under such circumstances, the curtain will begin to be raised merely by releasing the brake. The opposing force from the curtain will decrease since only the wound-out portion thereof exerts any force due to gravity. Only the mass of the portion of the curtain that is not yet wound up has any effect.

Motion continues until the counterweight 5 reaches the bottom of its stroke, when the short belt 7 is fully wound out. Thereafter, the belt 7 winds up in the other direction so the counterweight 5 is raised. The force exerted by the counterweights is then a function of the mass difference $M_6-M_5$.

For example, this difference may be selected to compensate the residual weight of the curtain so that it continues to move up until it is fully wound up.

If the two counterweights are of equal mass (exerting equal forces, taking account of the wind-up diameters of the belts), the curtain will stop in this position, and this applies even more so if the counterweight 5 is heavier than the counterweight 6.

It can be seen that the masses of the counterweights can be selected so as to have a desired initial force $M_6+M_5$ and a smaller force $M_6-M_5$ during the second portion of the stroke. This makes it possible to reduce the maximum force required of the motor. If the masses are large enough and with an appropriate choice for the value of $M_6-M_5$, the curtain may be raised without the drive from a motor (e.g. in the event of a breakdown), at least up to a certain height, or all the way up if so desired.

When the short belt is wound out in full, the short counterweight is at its lowest position, i.e. it cannot move down any further. This lowest position corresponds to some intermediate height for the bottom of the curtain. This height can be selected at will by an appropriate choice of length for the short belt. The intermediate height may be situated about halfway up the total opening height of the curtain, so as to match the counterweight force to the mass of the non-wound-up fraction of the curtain. This intermediate height may be situated in the top portion of the door-bay so as to adapt the differential force between the counterweights to damping the movement of the curtain towards the end of its up stroke.

I claim:

1. A balancing apparatus for a raisable-curtain goods-handling door, said apparatus comprising:

a shaft for raising and lowering a curtain; and a first drum operatively coupled to said shaft;

a first belt attached to said first drum so as to permit said first belt to be wound around said first drum in response to rotation of said shaft;

a second drum operatively coupled to said shaft;

a second belt attached to said second drum so as to permit said second belt to be wound around said second drum in response to rotation of said shaft;

a first weight attached to the distal end of said first belt; and a second weight attached to the distal end of said second belt;

wherein said first belt has a length corresponding to a full stroke of said curtain, wherein the length of said second belt is less the length of said first belt, and wherein said second weight is attached to said second rum using said second belt so as to permit said second belt to wind in either direction on said second drum.

2. The apparatus according to claim 1, wherein said first weight is greater than said second weight.

3. The apparatus according to claim 2, wherein a difference in weight between said first and said second weights is greater than a portion of a weight of a corresponding portion of said curtain that is not wound up when said second belt is fully wound out.

4. The apparatus according to claim 1, wherein said curtain is disposed between said first drum and said second drum.

* * * * *